US010549973B2

(12) United States Patent
Puke

(10) Patent No.: US 10,549,973 B2
(45) Date of Patent: Feb. 4, 2020

(54) INDUSTRIAL TRUCK HAVING A CONTROL UNIT FOR REGULATING THE MOVEMENT OF A LOAD AND METHOD THEREFOR

(71) Applicant: Jungheinrich Aktiengesellschaft, Hamburg (DE)

(72) Inventor: Christian Puke, Hamburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 245 days.

(21) Appl. No.: 15/843,504

(22) Filed: Dec. 15, 2017

(65) Prior Publication Data

US 2018/0170734 A1 Jun. 21, 2018

(30) Foreign Application Priority Data

Dec. 15, 2016 (DE) ..... 10 2016 124 506

(51) Int. Cl.

| | |
|---|---|
| ***B66F 9/06*** | (2006.01) |
| ***B66F 9/22*** | (2006.01) |
| ***B66F 9/07*** | (2006.01) |
| ***B66F 9/10*** | (2006.01) |

(52) U.S. Cl.
CPC ..... *B66F 9/22* (2013.01); *B66F 9/07* (2013.01); *B66F 9/10* (2013.01)

(58) Field of Classification Search
None
See application file for complete search history.

(56) References Cited

U.S. PATENT DOCUMENTS

| | | | | |
|---|---|---|---|---|
| 3,179,198 A * | 4/1965 | Hastings, Jr. | ..... | B60T 7/12 180/65.1 |
| 5,738,187 A * | 4/1998 | Dammeyer | ..... | B66F 9/0755 187/222 |
| 5,995,001 A * | 11/1999 | Wellman | ..... | B66F 17/003 340/438 |
| 6,059,514 A * | 5/2000 | Sanchez | ..... | B66F 9/195 108/51.3 |
| 6,135,694 A * | 10/2000 | Trego | ..... | B66F 9/24 414/21 |
| 7,182,369 B2 * | 2/2007 | Baumann | ..... | B62D 21/04 280/781 |

(Continued)

FOREIGN PATENT DOCUMENTS

| | | |
|---|---|---|
| DE | 102006012982 A1 | 11/2007 |
| DE | 102007015488 A1 | 10/2008 |

(Continued)

OTHER PUBLICATIONS

EP 17207695; filed Dec. 15, 2017; European Search Report dated Apr. 16, 2018; 3 pages.

*Primary Examiner* — Jonathan M Dager
(74) *Attorney, Agent, or Firm* — Barclay Damon LLP

(57) ABSTRACT

An industrial truck comprising a lift frame with a load part for carrying a load, a reach carriage acting on the lift frame for moving the lift frame forward and backward, at least one sensor configured to measure an actual speed of the reach carriage, and a control unit configured to specify a target speed for the reach carriage, to determine a control deviation of the actual speed measured by the at least one sensor from the target speed, and to regulate the movement speed of the reach carriage based on the determined speed deviation.

11 Claims, 7 Drawing Sheets

(56) References Cited

U.S. PATENT DOCUMENTS 7,967,335 B2 * 6/2011 Bergmeier ..... B66F 9/07559 180/210
9,002,557 B2 * 4/2015 Goncalves ..... B66F 17/003 701/22
9,302,893 B2 * 4/2016 Goncalves ..... B66F 17/003
10,077,177 B2 * 9/2018 Lynn ..... B66F 17/003
2005/0171668 A1 * 8/2005 Allerding ..... F15B 13/0442 701/50
2005/0198950 A1 * 9/2005 Nissen ..... B66F 9/22 60/420
2005/0263354 A1 * 12/2005 Perkins ..... B66F 9/22 187/226
2006/0233633 A1 * 10/2006 Passeri ..... B66F 9/22 414/631
2007/0080024 A1 * 4/2007 Langenkamp ..... B66F 9/08 187/222
2009/0312875 A1 * 12/2009 Lehtonen ..... B66F 9/07559 700/280
2010/0065377 A1 * 3/2010 Billger ..... B66F 9/08 187/226
2012/0209478 A1 * 8/2012 Dammeyer ..... B66F 9/07 701/50
2012/0239262 A1 * 9/2012 Reinert ..... B66F 9/07559 701/50
2014/0277958 A1 * 9/2014 Yahner ..... B66F 9/0755 701/50
2015/0098780 A1 * 4/2015 Robolotti ..... B66F 9/10 414/471
2015/0100210 A1 * 4/2015 Hoock ..... B66F 9/10 701/50
2017/0036898 A1 * 2/2017 Goncalves ..... B66F 9/0755
2017/0297879 A1 * 10/2017 Franzen ..... B66F 9/0755

FOREIGN PATENT DOCUMENTS

DE 102007024817 A1 10/2008
DE 202012002445 U1 8/2013
DE 102014115152 A1 4/2016
EP 1447373 A1 8/2004
EP 1975114 A1 10/2008
WO 2008/006928 A1 1/2008

* cited by examiner

INDUSTRIAL TRUCK HAVING A CONTROL UNIT FOR REGULATING THE MOVEMENT OF A LOAD AND METHOD THEREFOR

CROSS REFERENCE TO RELATED INVENTION

This application is based upon and claims priority to, under relevant sections of 35 U.S.C. § 119, German Patent Application No. 10 2016 124 506.2, filed Dec. 15, 2016, the entire contents of which are hereby incorporated by reference.

TECHNICAL FIELD

The invention relates to an industrial truck with a control unit for regulating the movement of a reach carriage acting on a lift frame of an industrial truck, and such a method.

BACKGROUND

Known industrial trucks normally have a vehicle frame and a lift mast with a load part. The load part and individual mast stages of the lift mast can be extended and retracted, while the lift mast can be tilted forward and aft and advanced and withdrawn on a reach carriage. Industrial trucks with a reach carriage are normally termed reach trucks. Moreover, known industrial trucks have a control unit for an operator to command a speed input which may be realized by a drive unit. For example, the lifting function, tilting function and thrusting function of the industrial truck can be realized by the drive. Generally, this is a hydraulic drive with one or more hydraulic cylinders. For example, to control the actual speed of the reach carriage, the control translates a specified speed into a manipulated variable corresponding to the characteristic of the hydraulic valve. The volumetric flow of the hydraulic fluid flowing into the hydraulic cylinder is controlled corresponding to this manipulated variable. The reach carriage at the foot of the lift frame is moved by the hydraulic cylinder, which causes a movement of the lift frame, and, hence the load. Unfortunately, the actual speed of the reach carriage can differ from the specified speed due to external influences such as production tolerances, fluctuating frictional forces, material wear or other static or dynamic forces.

Additionally, the thrust frame, and, hence, the load can experience undesirable vibration from the movement of the reach carriage. Such vibrations can be reduced by accelerating, or respectively, delaying the thrust mast gently in predefined operating positions. Such a method is, for example, known from WO 2008 006 928 A1. In this method the initial natural frequency of the thrust frame can be determined based on different operating parameters of the industrial truck such as the lift height and weight of the transported load.

Active mass vibration dampings are also known to measure variables proportional to the vibrations such as acceleration or a strain of the lift frame, and control the movement of the thrust mast based on these measured variables. Such active vibration damping is, for example, known from DE 10 2007 024 817 A1 wherein regulation occurs as a consequence of a movement characteristic of the thrust mast actuator saved in the control device for different operating situations of the industrial truck. Methods for active vibration damping are also known from EP 1 975 114 A1 and DE 10 2006 012 982 A1.

A need, therefore, exists for a control unit which ensures that the reach carriage, and, hence the load located on the lift frame, achieves a speed commanded by the operator.

BRIEF SUMMARY OF THE INVENTION

A control unit is provided to An industrial truck is provided with a control unit operative to ensure that the commanded speed of a reach carriage for an industrial truck is precisely maintained. The industrial truck comprises: a lift frame having a load part for carrying a load; a reach carriage connecting to the lift frame for moving the lift frame forward and aft; at least one speed sensor configured to measure an actual speed of the reach carriage and issue an actual carriage speed signal indicative thereof; and a control unit configured to: (i) receive a target speed of the reach carriage and issue a target carriage speed signal indicative thereof, (ii) compare the actual carriage speed signal to the target carriage speed signal and issue a control deviation signal indicative of the difference between the actual and target carriage speed signals, and regulate the adapted speed of the reach carriage in response to the determined control deviation signal.

A method is also provided for regulating the movement of a reach carriage acting on a lift frame of an industrial truck such that the speed commanded or specified by the operator is maintained. The method comprises the steps of: (i) commanding a target speed of the reach carriage via an operator input unit and issuing a target carriage speed signal indicative thereof; (ii) measuring an actual speed of the reach carriage by a sensor unit of the industrial truck and issuing an actual carriage speed signal indicative thereof; (iii) comparing the actual carriage speed signal to the target carriage speed signal by a control unit of the industrial truck and issuing a control deviation signal indicative of the difference between the actual and target carriage speed signals; and (iv) regulating the actual speed of the reach carriage in response to the control deviation signal.

The industrial truck can, for example, be a forklift, and in particular, a reach truck. According to an embodiment of the invention, the industrial truck comprises: a lift frame with a load part. The lift frame can have a lift mast with one or more mast stages, and be connected to a chassis of the industrial truck having a drive part. The load part can for example be a load fork. The load part serves to receive a load, such as a pallet, to be transported by the industrial truck. The lift frame can be moved forward and backward by a reach carriage, wherein this is to be understood as a movement in the direction of travel, or opposite the direction of travel of the industrial truck. Thus, the reach carriage can act on the lift frame at a foot of the lift frame and, in particular, be connected thereto. The lift frame can be moved backward, or respectively forward by retracting, or respectively extending the reach carriage. In so doing, the reach carriage is moved at a given target speed. The target speed can be specified by an operator of the industrial truck, for example using a control lever arranged on the industrial truck.

Moreover, the industrial truck comprises a sensor for measuring the actual speed of the reach carriage. Since the reach carriage acts on the lift frame, the actual speed of the lift frame can be determined. The sensor can for example be arranged on the reach carriage. The sensor can also be arranged on a hydraulic cylinder acting on the reach carriage. This actual speed is transmitted to, or requested, by the control unit. The control unit compares the specified target speed of the reach carriage with the actual speed measured by the sensor and thereby determines any control deviation. Based on this control deviation, the movement speed of the reach carriage is adjusted. For example, a difference can be formed between the target speed and the actual speed.

The speed sensor can derive the actual speed of the reach carriage from a path measurement, for example. When the lift frame moves backward and forward relative to a drive part, or respectively chassis of the industrial truck, a certain distance is traveled. This distance can for example have a code so that a measuring method that counts increments can be used to measure speed.

According to one embodiment of the disclosure, the control unit of the industrial truck not only specifies a target speed for the reach carriage, it also adjusts the actual speed of the reach carriage when it deviates from the target speed. Such measurement and adjustment of the actual speed of the reach carriage makes it possible to reliably maintain the actual speed that was commanded or specified by the operator of the industrial truck. Accordingly, the influence of external disruptive factors such as production tolerances, fluctuating friction and material wear or others static or dynamic forces can be compensated. As noted in the Background of this disclosure, a target speed value oftentimes cannot be precisely reached using the control algorithms due to the aforementioned disruptive factors. As a consequence, the specified or target speed may be undershot or exceeded. When the specification is exceeded, dangerously high speeds can occur that may even exceed the maximum speed suggested or prescribed by the manufacturer. When the specification is undershot, the workflow is reduced or slows. With the speed regulation according to the invention, the specified value is contrastingly achieved with a high degree of precision, which enables a fast workflow while simultaneously maintaining safety precaution According to an embodiment, the industrial truck moreover comprises at least one deformation sensor configured to measure a deformation of the lift frame, wherein the control unit is moreover designed to regulate the movement speed of the reach carriage on the basis of the measured deformation of the lift frame. According to this embodiment, a deformation of the lift frame is measured by at least one deformation sensor and is either regulated by the first control unit that is also responsible for regulating speed, or by a separate, second control unit that regulates the reach carriage movement on the basis of the measured deformation. The deformation sensor of the lift frame can determine the lift frame deformation for example by a relative acceleration of a top-end of the lift frame relative to the foot of the lift frame. The deformation sensor can be an acceleration sensor such as for example a accelerometer disposed on a top end of the lift frame. Alternatively, the deformation sensor can also be designed as a strain sensor such as a strain gauge.

The deformation sensor can then measure a strain of the lift frame, wherein the strain for example can be caused by a bending of the lift frame. In particular, a change in the strain can be measured. Information measured by the deformation sensor is transmitted to the control unit which then regulates the reach carriage speed to compensate the deformation of the lift mast. In particular, two deformation sensors, preferably acceleration sensors, can be provided. A first of the two deformation sensors can be arranged on a top mast end, and a second deformation sensor can be arranged on a bottom mast end. Providing at least a second deformation sensor makes it possible to determine a reference acceleration. With this embodiment, active mast damping can accordingly also be achieved, i.e., a compensation of undesirable mast vibrations. This ensures that the reach carriage speed specified by the operator can be reliably maintained even when mast vibrations occur.

A second control unit can also be provided configured to regulate the movement speed of the reach carriage on the basis of the measured lift frame deformation. Two control units can hence be provided, wherein the first control unit processes the actual speed of the reach carriage measured by the sensor, whereas the second control unit processes the deformation of the lift frame measured by the deformation sensor. Based on the measured data from both sensors, the first and/or the second control unit can then regulate the actual speed. The advantage of two separate control units is that they can both be designed independent of each other. It is also possible, however, to realize the two control units as independent software modules of a single physical control unit.

According to another embodiment, the industrial truck has a hydraulic power unit with at least one hydraulic cylinder acting on the reach carriage, wherein the control unit is designed to control the movement speed of the reach carriage by changing the volumetric flow of hydraulic fluid flowing in the hydraulic cylinder. According to this embodiment, the control unit can control a hydraulic power unit of the industrial truck. This hydraulic power unit can comprise one or more hydraulic cylinders that act on the reach carriage. The reach carriage can hence also be moved by a hydraulic cylinder. By regulating the volumetric flow into, or respectively out of, the at least one hydraulic cylinder, it can be extended, or respectively retracted, which eventuates in a corresponding movement of the reach carriage. The lift frame and load located on the load part of the lift frame are then moved by the movement of the reach carriage.

The hydraulic power unit can also comprise additional hydraulic cylinders by means of which, for example, a lifting function and/or a tilting function of the load part, or respectively the lift frame is enabled. If the control unit discerns a deviation between the target and actual speed of the reach carriage, it can adjust the volumetric flow of the hydraulic fluid flowing into the hydraulic cylinder such that the desired target speed is achieved. In doing so, it can be provided to arrange the speed sensor according to the invention on the hydraulic cylinder acting on the reach carriage. For example, the sensor can measure the movement speed of a piston rod of the hydraulic cylinder relative to a cylinder housing of the hydraulic cylinder. For this, an incremental measuring method can, in particular, be provided, wherein the piston rod then has a code at even distances.

According to another embodiment, the hydraulic power unit has a hydraulic pump and/or at least one control valve, wherein the volumetric flow of hydraulic fluid flowing into the hydraulic cylinder is regulated by the hydraulic pump and/or the at least one control valve. If there is any deviation in the actual speed of the reach carriage, the control unit can then increase or reduce the volumetric flow using the hydraulic pump. The control unit can further open or close the at least one control valve to regulate the volumetric flow.

BRIEF DESCRIPTION OF THE DRAWINGS

The invention will be further explained below with reference to the figures.

DETAILED DESCRIPTION OF THE INVENTION

Figure 1:
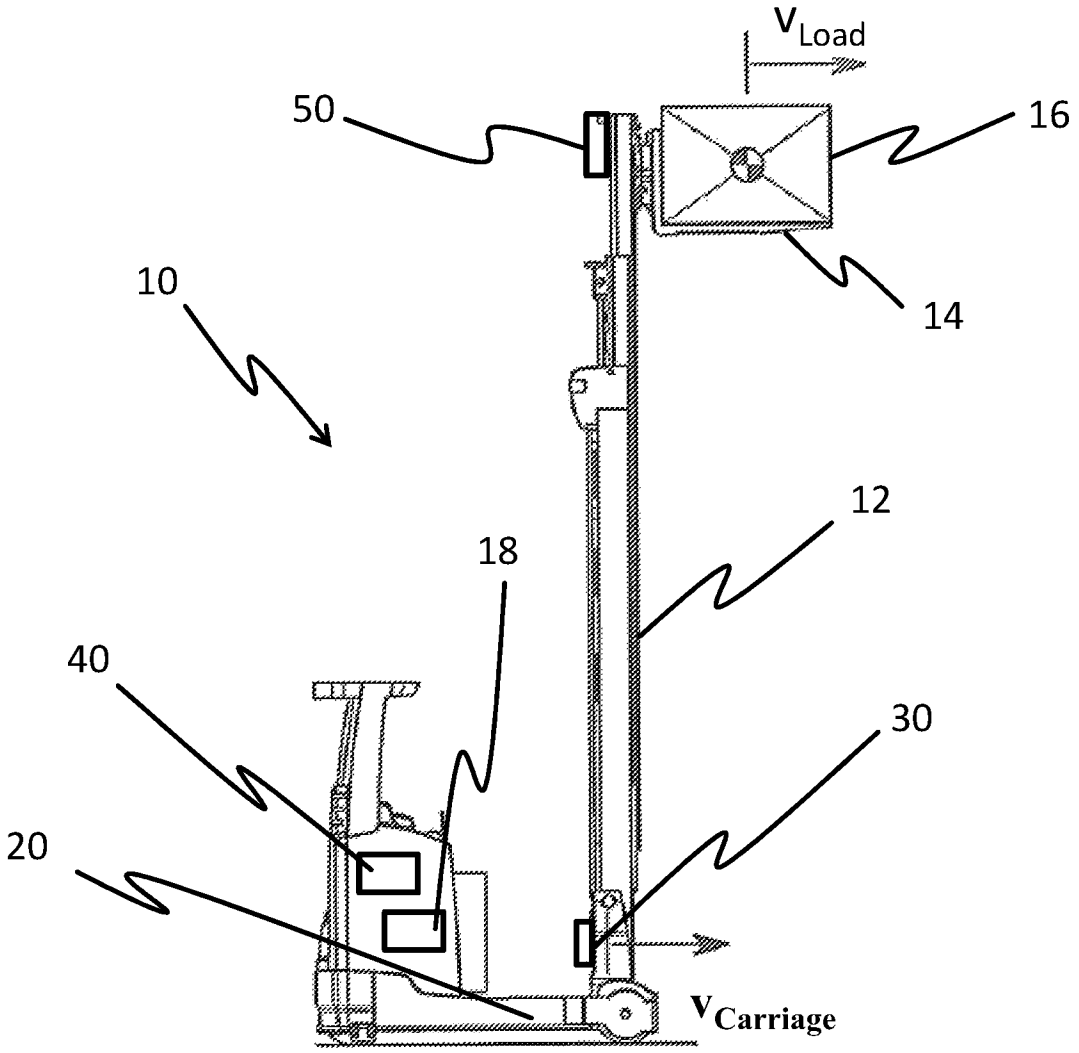
FIG. 1 shows an industrial truck according to an embodiment of the disclosure.

FIG. 1 depicts an industrial truck 10 with a lift frame 12, a reach carriage 20, a sensor 30, and a control unit 40. The sensor 30 is arranged at a base or foot of the lift frame 12. The lift frame 12 comprises a load part 14 with a load 16 located thereupon. A hydraulic power unit 18 connects to the vehicle frame of the industrial truck 10 and comprises: (i) a hydraulic pump (not shown) and (ii) at least one hydraulic cylinder acting on the reach carriage 20. A deformation sensor 50 is arranged at the top or tip of the lift frame 12. In the described embodiment, the industrial truck 10 is a reach truck whose lift frame 12 can be extended by the reach carriage 20 in the direction of the arrow indicated by VCarriage, and retracted in the opposite direction. Additionally, the load 16 located on the load part 14 may be displaced forward and aft or backward at a speed VLoad.

Figure 2:
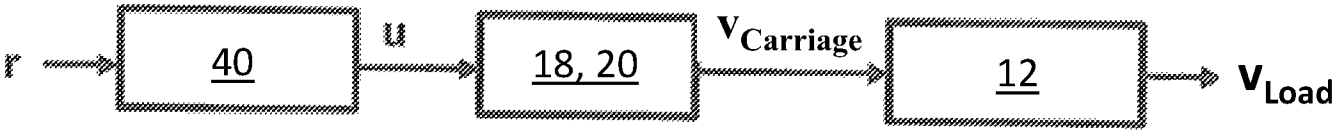
FIG. 2 depicts a schematic diagram of the speed control of the reach carriage.

In FIG. 2, an operator of the reach truck 10 can transmit a specified speed r to the control unit 40 by means of an operating unit (not shown). The control unit 40 transmits a manipulated variable u corresponding to the specified speed r to the hydraulic power unit 18, in particular to the hydraulic pump, or respectively the at least one hydraulic cylinder, and accordingly to the reach carriage 20. The reach carriage 20 is may be moved at a speed VCarriage. The lift frame 12, and, accordingly, the load 16 is subsequently moved by the reach carriage 20. In this context, the actual reach carriage speed VCarriage, i.e., the speed of the foot of the lift frame, may deviate from the specified speed rdue to external influences such as production tolerances, fluctuating friction and material wear.

Figure 3:
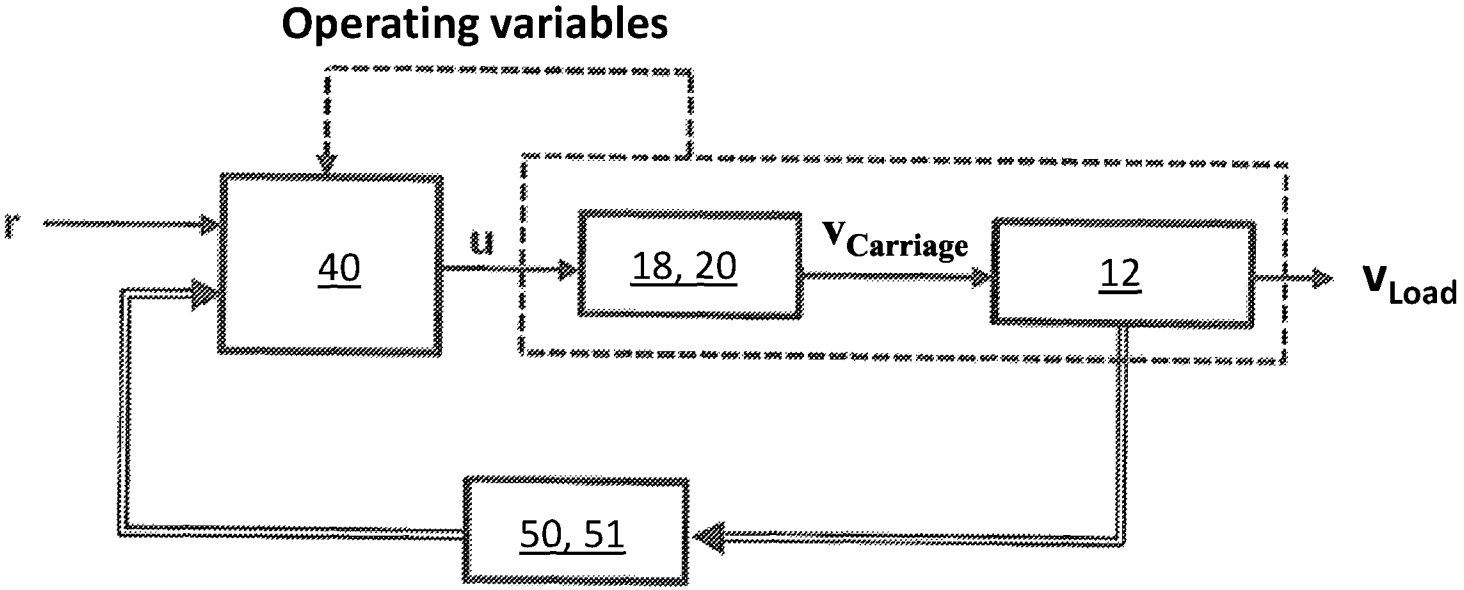
FIG. 3 depicts a schematic regulation diagram for compensating mast vibrations.

As also mentioned in the Background Section, movement of the reach carriage 20 can induce undesirable vibrations of the load 16 located on the load part 14. In this case, there may be a deviation between the speed VCarriage of the reach carriage 20 and the speed VLoad of the load 16. FIG. 3 shows a diagram of active mast damping to suppress such vibrations. In comparison to the control shown in FIG. 2, operating variables of the industrial truck on the one hand and a deformation of the lift frame 12 on the other hand are taken into consideration. Operating variables can, for example, be the weight of the load 16 and the lift height of the lift frame 12. In the described embodiment, the deformation sensor 50 is an acceleration sensor, e.g., an accelerometer, that measures the actual acceleration of the top end of the lift frame 12 in comparison to the foot of the lift frame 12. The measured acceleration value and the measured operating variables enter the control unit 40. In addition, another acceleration sensor 51 is provided at the base or bottom mast end to provide a reference acceleration value. The measured value is entered into the control unit 40 represented by the double lined arrow running from the lift frame 12 to the control unit 40. The control unit 40 regulates the movement of the reach carriage 20 by means of the hydraulic power unit 18, such that vibration of the load 16 is compensated.

Figure 4:
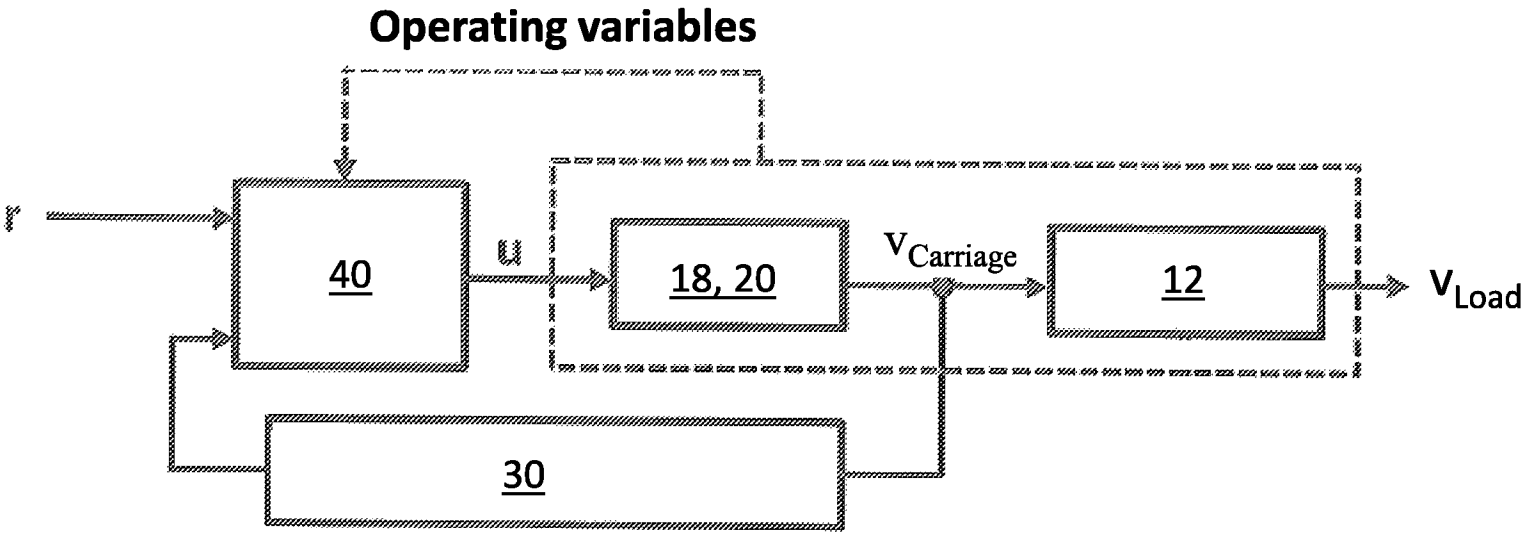
FIG. 4 depicts a schematic regulation diagram of the speed control of the reach carriage.

FIG. 4 shows the regulation of the actual speed of the reach carriage according to the invention. Similar to the control schematic shown in FIG. 2, a specified speed r is input by an operator into the control unit 40 to control the hydraulic power unit 18. As such, The reach carriage 20 may be manipulated or controlled by variable u. The lift frame 12, and accordingly, the load 16, is moved by the reach carriage 20 at a speed VLoad. In so doing, a sensor 30 measures the actual speed VCarriage of the reach carriage 20 and transmits this value, or an actual speed signal, to the control unit 40. The control unit 40, then determines a control deviation value between a target speed value i.e. the specified or commanded target speed signal r, input by the operator and the actual speed value or signal, i.e., the reach carriage speed VCarriage. As such, The control unit issues a control deviation signal to adapt the manipulated variable u. By adapting the manipulated variable u, a the hydraulic drive unit 18 may be adapt the actual speed of the reach carriage 20. The measurement and adjustment of the actual speed of the reach carriage 20 may be continuous or provided in steps. In the embodiment shown in FIG. 4, additional operating variables of the vehicle may be determined for entry into the control unit 40. Accordingly, depending on the lift height and load weight, the carriage 20 and the lift frame 12 may be accelerated, in a positive or negative direction to prevent mast vibration.

Figure 5:
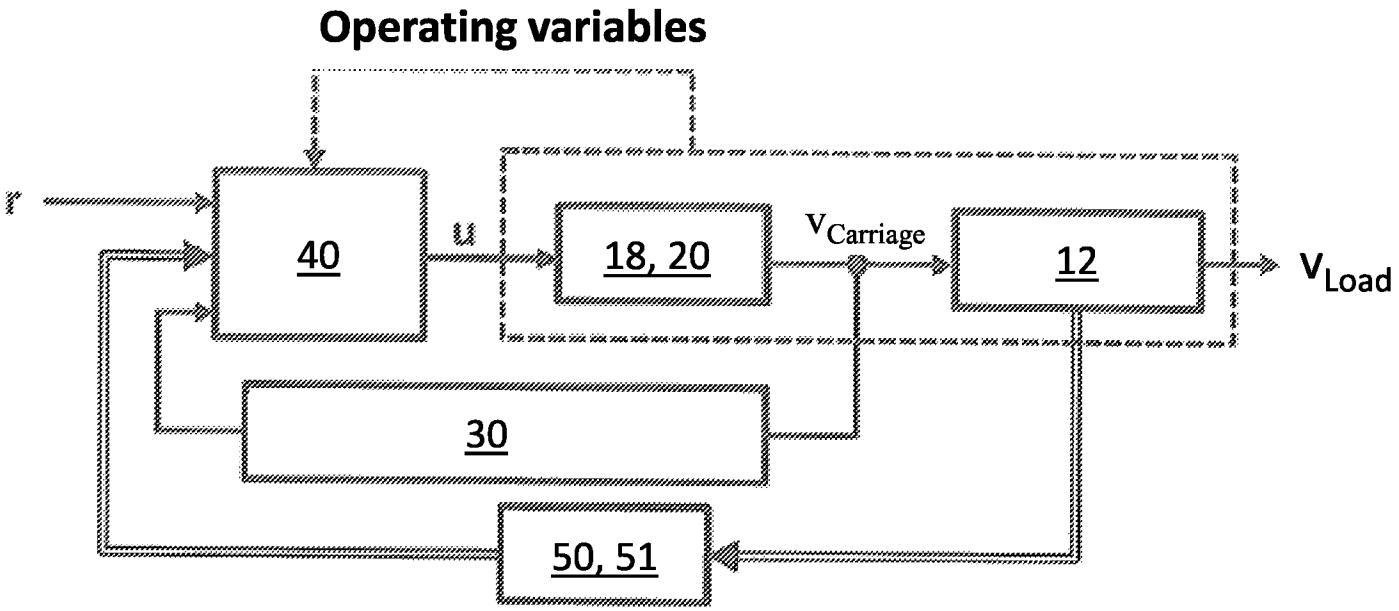
FIG. 5 depicts the schematic regulation diagram of FIG. 4 in combination with active mast damping.

In another embodiment shown in FIG. 5, the control algorithm of FIG. 4 is expanded by active mast damping. In this embodiment, two acceleration sensors 50, 51 determine a deformation value of the lift frame 12 and a signal indicative to the deformation value to the control unit 40, as discussed supra with reference to FIG. 3. According to this embodiment, the actual speed regulation is combined with active mast damping. Whereas a first control loop of the control unit 40 effects speed regulation by determining the actual speed of the reach carriage 20, i.e., ensuring that the actual speed VCarriage of the reach carriage 20 corresponds to the specified speed r, a second control loop (active mast damping) ensures that the speed VLoad of the lift frame 12, and the displaced load 16, corresponds to the speed VCarriage of the reach carriage 20. When the variable measured by the acceleration sensors 50, 51 reaches a constant value, the speed VLoad is, therefore, equal to the speed VCarriage. If, in addition the measured speed VCarriage of the reach carriage 20 corresponds to the specified speed r, this ensures that the load 16 also moves at the specified speed r.

Figure 6:
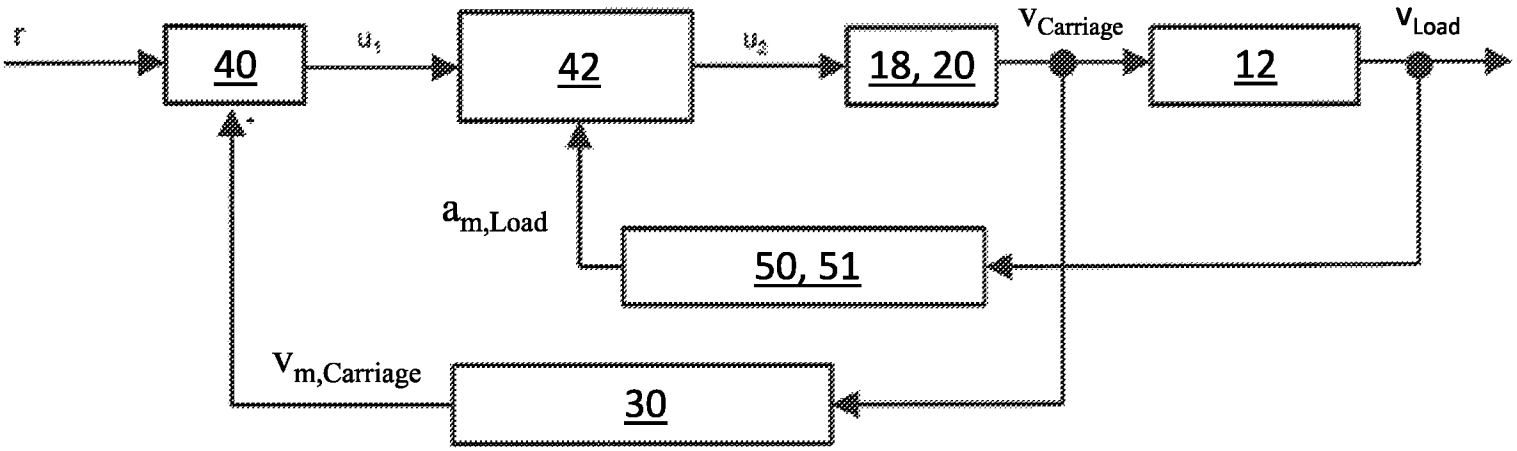
FIG. 6 depicts a schematic of a cascaded combination of the speed control with active mass damping.

FIG. 6 shown another embodiment of the disclosure wherein speed is regulated together with vibration damping. In contrast to the embodiment shown in FIG. 5, this embodiment is configured by a cascaded speed regulation or by a speed value which is modified in series. For this, a commanded or specified speed r is input by an operator to the control unit 40 which subsequently transmits a regulating variable u1 to a second control unit 42. The second control unit 42 forwards the specification as a regulating variable u2 to the hydraulic power unit 18, and upon input to the reach carriage 20 brings about a transfer of the speed VCarriage to the lift frame 12, and to the speed VLoad of the load 16.

The actual speed is regulated with in first control loop by a speed sensor 30 which determines the actual speed Vm,Carriage of the reach carriage 20. The first control unit 40 determines any control deviations between the commanded, specified, or target speed r and the measured, or actual reach carriage speed Vm,Carriage. The control deviation value is input to the control unit 40 which forwards a manipulated variable u1 to the second control unit 42. The second control unit 42 also receives an actual acceleration am,Load value of the load 16 from the deformation sensors 50, 51 designed as acceleration sensors. However, only one deformation sensor can be provided. Corresponding to the manipulated variables u1 and am,Load, the second control unit 42 forwards a changed manipulated variable u2 to the hydraulic power unit 18 which brings about an adaptation of the actual speed VCarriage of the reach carriage 20. On the one hand, the actual speed of the reach carriage 20 is regulated to the specified speed r, and on the other hand, the load speed VLoad is regulated to the reach carriage speed VCarriage. This accordingly ensures that the actual speed of the load also corresponds to the specified, commanded or target speed. In comparison to the embodiment from FIG. 5, the embodiment from FIG. 6 has the advantage that the two control units 40, 42 which are independent from each other can be designed as desired and independent from each other. It should also be appreciated that the two control units 40, 42 may act independently, or in combination, as a single physical control unit.

Figure 7:
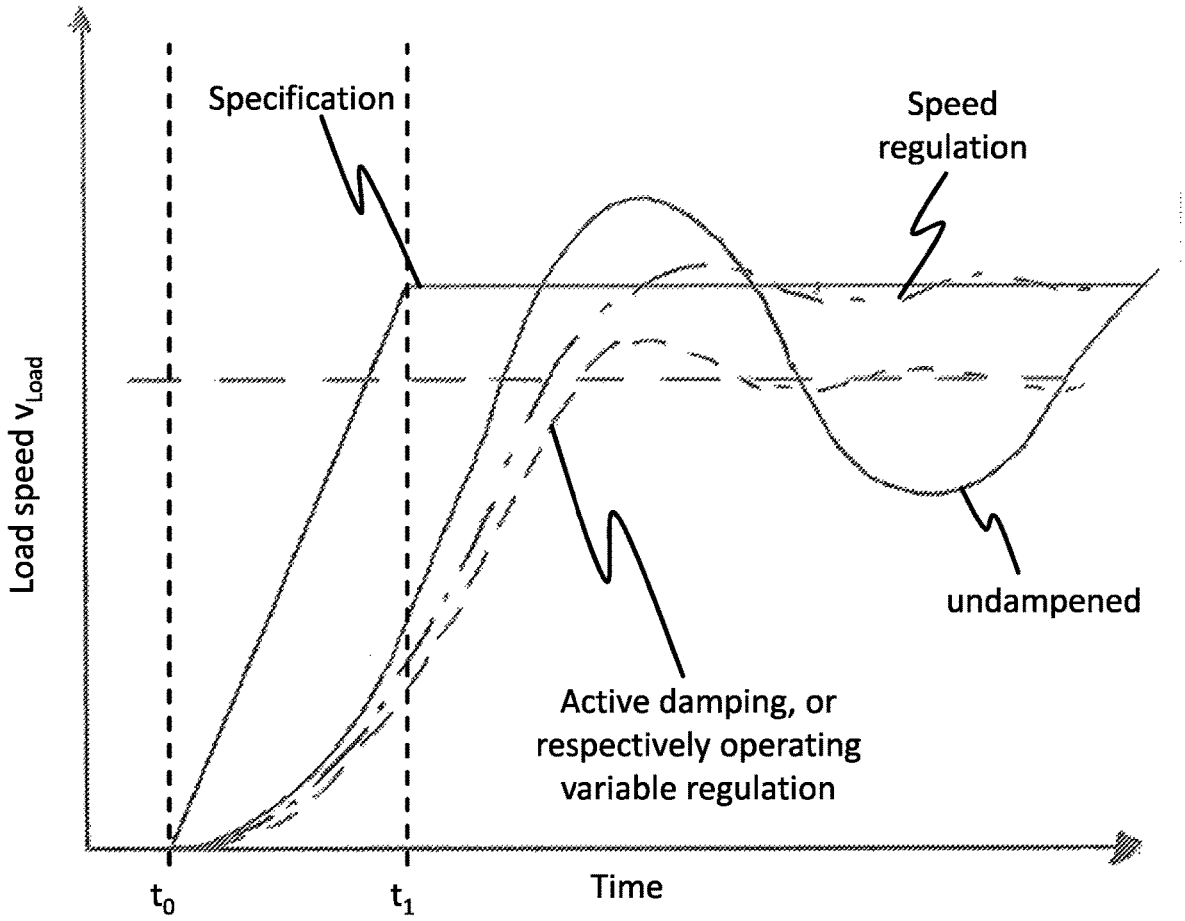
FIG. 7 depicts a schematic diagram of the representative behavior of the load speed over the course of time.

FIG. 7 shows the behavior of the load speed vLoad over the course of time. At time t0, an operator starts to specify a speed. This specified speed corresponds to the curve identified as "Specification". At time t1, the speed rises continuously or linearly, and reaches a specified constant speed. As such, an undampened system behaves according to the solid line identified as "undampened". This would correspond to the control algorithm shown in FIG. 2. The load speed first rises slowly and then faster, such that the actual speed overshoots the target or specified speed as a consequence of the vibration induced by the lift frame. Due to a subsequent swing-back effect of the lift frame, the load speed VLoad drops far below the target or specified speed and rises once again as the lift mast swings forward again. In a long-lasting vibration, the load speed VLoad approaches the target or specified speed.

Industrial trucks having variable control, or with respectively active mast damping as shown in FIG. 3 or 4, manifest significantly reduced vibration behavior. Given the feedback of the operating variables, or respectively the load acceleration, the load speed can be regulated in the explained manner such that the vibration of the lift frame has a significantly reduced amplitude and reaches a constant value faster. However, since as previously mentioned, these systems do not employ speed regulation, the specified speed value is frequently not precisely reached and is instead undershot or exceeded. When the specification is exceeded, dangerously high speeds can occur that may even exceed the maximum speed given by the manufacturer. If the specification is undershot, the work process slows down. In FIG. 7, the load speed VLoad oscillates around a value lower than the specification, which causes a delay of workflow.

However, the curve identified as "speed regulation" is achieved by the method or the industrial truck according to the invention for regulating the actual speed of the reach carriage. This corresponds to the control loops shown in FIGS. 4 and 5. In addition to strongly reducing the vibration, the load speed is also regulated within a short time to the actually desired specified speed. Accordingly, a high work tempo can be achieved, and the required safety can simultaneously be guaranteed.

The invention claimed is:

1. An industrial truck, comprising:

a lift frame having a load part for carrying a load;

a reach carriage connecting to the lift frame for moving the lift frame forward and aft;

at least one speed sensor configured to measure an actual speed of the reach carriage and issue an actual carriage speed signal indicative thereof; and a control unit configured to: (i) receive a target speed of the reach carriage and issue a target carriage speed signal indicative thereof, (ii) compare the actual carriage speed signal to the target carriage speed signal and issue a control deviation signal indicative of a difference between the actual and target carriage speed signals, and (iii) regulate the actual speed of the reach carriage in response to the control deviation signal.

2. The industrial truck of claim 1, further comprising at least one deformation sensor configured to measure a deformation of the lift frame and issue a deformation control signal indicative thereof, and wherein the control unit is configured to regulate the actual speed of the reach carriage in response to the deformation control signal in connection with the lift frame.

3. The industrial truck of claim 1, further comprising at least one deformation sensor configured to measure a deformation of the lift frame and issue a measured deformation signal indicative thereof, and a second control unit configured to regulate the actual speed of the reach carriage in response to the measured deformation signal.

4. The industrial truck of claim 1, wherein the industrial truck comprises at least one hydraulic cylinder acting on the reach carriage and a hydraulic power unit configured to supply hydraulic fluid to the at least one hydraulic cylinder, and wherein the control unit is responsive to the target carriage speed signal to vary a volumetric flow of hydraulic fluid in the hydraulic cylinder to control the actual speed of the reach carriage.

5. The industrial truck of claim 4, further comprising a hydraulic pump, and wherein the volumetric flow of hydraulic fluid into the hydraulic cylinder is regulated by the hydraulic pump.

6. The industrial truck of claim 4, further comprising a hydraulic pump and wherein the volumetric flow of hydraulic fluid into the hydraulic cylinder is regulated by at least one control valve.

7. A method for regulating movement of a reach carriage connected to a lift frame of an industrial truck, wherein the method comprises the steps of:

commanding a target speed of the reach carriage by an operator input unit and issuing a target carriage speed signal indicative thereof;

measuring an actual speed of the reach carriage by a sensor unit of the industrial truck and issuing an actual carriage speed signal indicative thereof;

comparing the actual carriage speed signal to the target carriage speed signal by a control unit of the industrial truck and issuing a control deviation signal indicative of a difference between the actual and target carriage speed signals; and regulating the actual speed of the reach carriage in response to the control deviation signal.

8. The method of claim 7, further comprising the steps of measuring a deformation of the lift frame by a deformation sensor and issuing a measured deformation signal indicative thereof, and regulating movement of the reach carriage of the lift frame by at least one control unit in response to the measured deformation signal.

9. The method of claim 7, wherein the step of regulating the actual speed of the reach carriage further includes the step of varying a volumetric flow of hydraulic fluid flowing in a hydraulic cylinder acting on the reach carriage.

10. The method of claim 9, wherein the step of regulating the actual speed of the reach carriage further includes the step of varying the volumetric flow of hydraulic fluid flowing into the hydraulic cylinder by a hydraulic pump.

11. The method of claim 9, wherein the step of regulating the actual speed of the reach carriage further includes the step of varying the volumetric flow of hydraulic fluid flowing into the hydraulic cylinder by at least one control valve.

* * * * *